US011473365B2

(12) United States Patent
Lim

(10) Patent No.: US 11,473,365 B2
(45) Date of Patent: Oct. 18, 2022

(54) TUBE-SHAPED INCOMBUSTIBLE FABRIC FIRE DOOR GASKET HAVING FOAMED MEMBER INSERTED THEREIN

(71) Applicant: JUKYUNG TEX COMPANY, Pyeongtaek-si (KR)

(72) Inventor: Jae Kyong Lim, Incheon (KR)

( * ) Notice: Subject to any disclaimer, the term of this patent is extended or adjusted under 35 U.S.C. 154(b) by 0 days.

(21) Appl. No.: 17/284,864

(22) PCT Filed: Jul. 9, 2019

(86) PCT No.: PCT/KR2019/008390
§ 371 (c)(1),
(2) Date: Apr. 13, 2021

(87) PCT Pub. No.: WO2020/116737
PCT Pub. Date: Jun. 11, 2020

(65) Prior Publication Data

US 2021/0388670 A1 Dec. 16, 2021

(30) Foreign Application Priority Data

Dec. 7, 2018 (KR) ..... 10-2018-0156547

(51) Int. Cl.
*E06B 5/16* (2006.01)

(52) U.S. Cl.
CPC ..... *E06B 5/164* (2013.01)

(58) Field of Classification Search
USPC ..... 49/1
See application file for complete search history.

(56) References Cited

U.S. PATENT DOCUMENTS 4,246,304 A * 1/1981 Dixon ..... E06B 5/164 428/35.8
4,660,338 A * 4/1987 Wagner ..... E06B 5/164 49/504

(Continued)

FOREIGN PATENT DOCUMENTS

EP 2412912 A1 * 2/2012 ..... E06B 5/164
EP 3674380 A1 * 7/2020

(Continued)

OTHER PUBLICATIONS

English Specification of 20-0474104.

(Continued)

*Primary Examiner* — Marcus Menezes
(74) *Attorney, Agent, or Firm* — Antonio Ha & U.S. Patent, LLC

(57) ABSTRACT

A gasket comprises a tube body which is inserted into a groove of a fire door frame so as to block the movement of flames between a door and the door frame if a fire breaks out, and which has a joint part formed by rolling, in a tube shape, and adhering a ductile gasket cloth produced by coating, with flame-retardant or incombustible silicon, a fiber cloth manufactured by weaving the glass fibers, and a core body inserted into a hollow portion of the tube body so as to be foamed in a second foaming temperature condition if a fire breaks out, wherein the core body is formed so as to be expanded toward the outer side of the tube body while separating the joint part of the tube body by means of expansion pressure generated by foaming.

2 Claims, 4 Drawing Sheets

(56) References Cited

U.S. PATENT DOCUMENTS

| | | | | | |
|---|---|---|---|---|---|
| 5,916,077 | A * | 6/1999 | Tang | E06B 5/161 | 49/501 |
| 2003/0024184 | A1* | 2/2003 | Orr, Jr. | E06B 5/164 | 52/211 |
| 2009/0211163 | A1* | 8/2009 | Smith | E06B 5/164 | 49/475.1 |
| 2011/0016796 | A1* | 1/2011 | Foster | B29C 44/1209 | 49/477.1 |
| 2011/0314755 | A1* | 12/2011 | Langille | B32B 27/06 | 156/92 |
| 2020/0011126 | A1* | 1/2020 | Goldense | E06B 5/164 | |
| 2021/0025225 | A1* | 1/2021 | Paik | E06B 3/70 | |
| 2021/0032927 | A1* | 2/2021 | Brown | E04B 1/948 | |

FOREIGN PATENT DOCUMENTS

| | | | | | |
|---|---|---|---|---|---|
| FR | 2661100 | A * | 10/1991 | A62C 2/065 | |
| GB | 2087463 | A * | 5/1982 | E06B 5/16 | |
| GB | 2106972 | A * | 4/1983 | E06B 5/164 | |
| GB | 2289497 | A * | 11/1995 | E05B 51/005 | |
| GB | 2550433 | A * | 11/2017 | E06B 5/164 | |
| JP | 2004-316082 | A | 11/2004 | | |
| KR | 10-2007-0105336 | | 10/2007 | | |
| KR | 10-2010-0068348 | | 6/2010 | | |
| KR | 20-0474104 | | 8/2014 | | |
| KR | 10-2017-0139255 | | 12/2017 | | |
| KR | 10-1816831 | | 1/2018 | | |
| WO | WO-2004005658 | A1 * | 1/2004 | E06B 1/325 | |

OTHER PUBLICATIONS

English Specification of JP2004-316082A.
English Specification of 10-2007-0105336.
English Specification of 10-2010-0068348.
English Specification of 10-2017-0139255.
English Specification of 10-1816831.

* cited by examiner

TUBE-SHAPED INCOMBUSTIBLE FABRIC FIRE DOOR GASKET HAVING FOAMED MEMBER INSERTED THEREIN

TECHNICAL FIELD

The present invention relates to a gasket for fire doors, and in particular, to a fabric gasket for fire doors, manufactured by coating a fabric woven with non-combustible fibers with flame-retardant silicone and rolling it in a tubular shape and forming an adhesive portion.

BACKGROUND ART

Korean Utility Model Registration No. 20-474104 discloses a structure in which silicone coating layers 201 and 203 are formed on one or both surfaces of an elastic non-combustible material layer 100, which is rolled into a cylindrical shape and have joint portions 301 and 303 formed along the longer edges thereof.

By the nature of the fabric, however, such a cylindrical gasket may be pressed and deformed due to the repeated opening and closing of the door and its fire resistance may thus weaken.

Korean Patent No. 10-1816831 discloses a structure in which a temperature-expandable foam is inserted into the hole of a synthetic resin gasket to fill the door gap with foam, thereby suppressing the passage of flame when a fire occurs. However, the synthetic resin and foam which are organic materials may not sufficiently withstand high temperatures but lost their function due to their poor non-combustibility.

DETAILED DESCRIPTION OF THE INVENTION

Technical Problems

The present invention aims to provide a foam member-inserted, non-combustible fabric gasket for a fire door, in which a foaming sponge is inserted into the hollow of a tubular fiberglass fabric gasket to achieve the functions of the gasket by sealing a gap, which may be caused between the fire door and the door frame when a fire occurs, by the foaming of the foam.

Means to Address Problems

To achieve the foregoing objects, according to the present invention, a foam member-inserted, non-combustible fabric gasket for a fire door is provided. The non-combustible fabric gasket is inserted into a groove in a door frame of the fire door to block movement of flames between the door and the door frame when a fire occurs. The non-combustible fabric gasket comprises a tubular body formed by rolling a flexible gasket fabric into a tubular shape and forming a joint portion by adhesion, the flexible gasket fabric formed by coating a fibrous fabric woven with non-combustible fibers with a flame-retardant or non-combustible coating material and a core body inserted into a hollow of the tubular body. The core body is foamed at a second foaming temperature when a fire occurs. As the joint portion of the tubular body is separated by expansion pressure of the foaming, the core body is expanded to an outside of the tubular body to move the tubular body away from the joint portion.

According to the present invention, the core body may be a foaming sponge that is first foamed by a first foam at the first foaming temperature lower than the second foaming temperature and may include a flame-retardant material and a second foam that is foamed at the second foaming temperature.

According to the present invention, the core body inserted in the tubular body may be formed to radially press-fit an inner wall of the tubular body in at least two opposite directions to elastically keep the tubular body in shape at a normal temperature before the fire occurs. The core body may have various cross-sectional shapes, such as a cross, circular, straight, triangular, L, or U shape.

Effects of the Invention

The foam member-inserted, tubular non-combustible fabric gasket for fire doors according to the present invention allows the door to open and close smoothly without resistance thanks to the ductility of the sponge, which is the core body thereof. The gasket may remain in shape, with the elastic core body inserted therein, thus allowing for enhanced heat insulation and anti-condensation functions. If a fire breaks out, the core body may be expanded at the second foaming temperature to open the joint portion of the tubular body and allow the core body to come out of the hollow and fill the gap which is caused between the door and the door frame by heat, thereby blocking the spread of flames and preventing asphyxiation from smoke exposure. Further, as the gap is completely sealed, heat insulation may be enhanced.

EMBODIMENTS TO PRACTICE THE INVENTION

Hereinafter, preferred embodiments of the present invention are described in detail with reference to the accompanying drawings. The terms used herein should be interpreted not in typical or dictionary definitions but to comply in concept with the technical matters of the present invention.

Disclosed below is a non-combustible fabric gasket for a fire door, which is inserted into a groove of the door frame of the fire door to block the movement of flames between the door and the door frame when a fire occurs.

Figure 1:
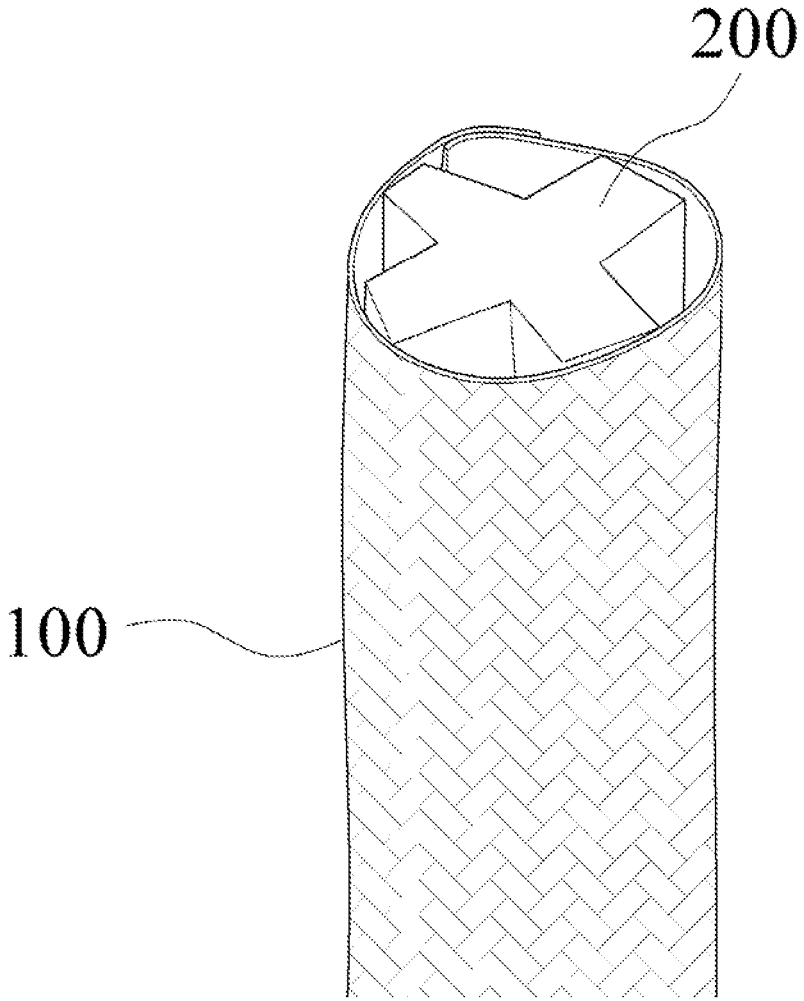
FIG. 1 is a perspective view illustrating a foam member-inserted non-combustible fabric gasket for a fire door according to an embodiment of the present invention.
Figure 2:
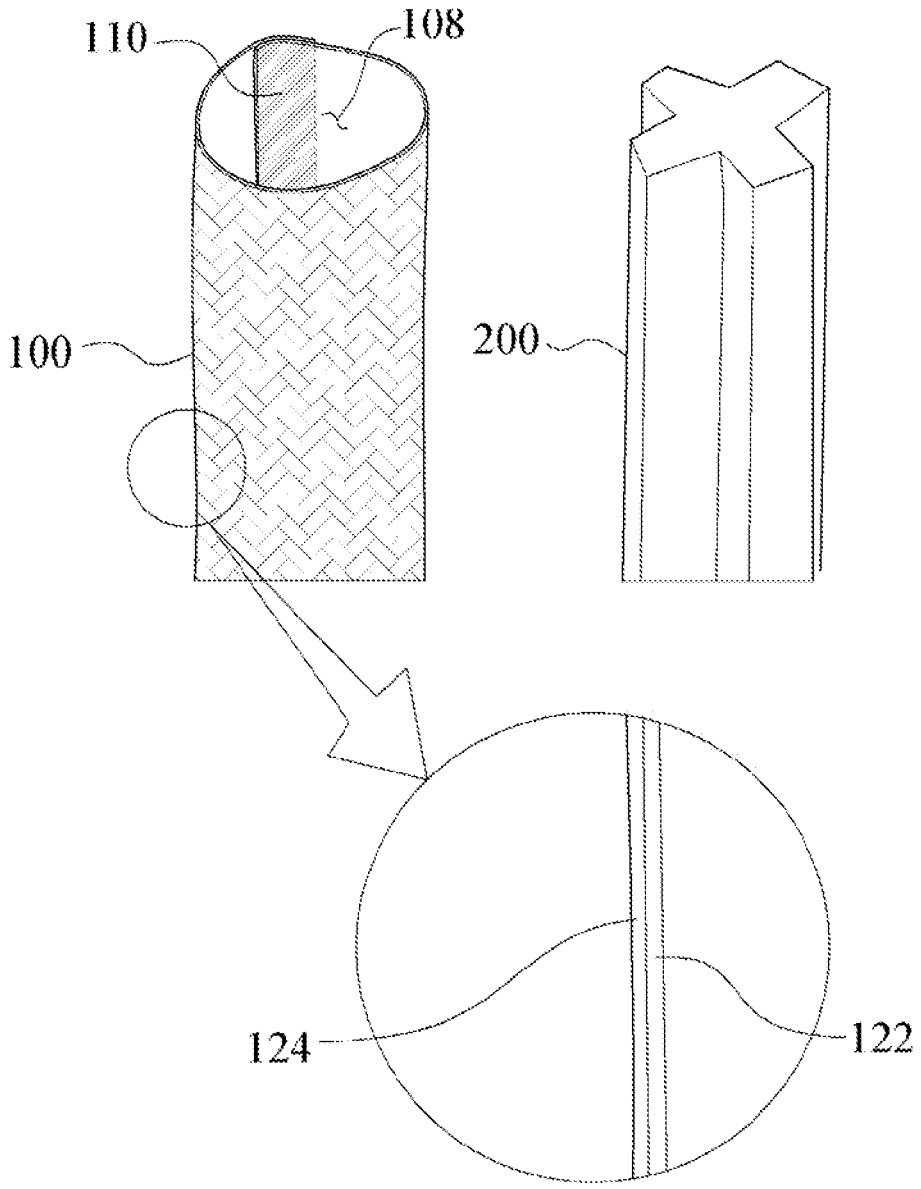
FIG. 2 is a perspective view illustrating the non-combustible fabric gasket of FIG. 1, with the core body removed from the tubular body.

FIG. 1 is a perspective view illustrating a foam member-inserted non-combustible fabric gasket for a fire door according to an embodiment of the present invention. FIG. 2 is a perspective view illustrating the non-combustible fabric gasket of FIG. 1, with the core body removed from the tubular body. Referring to FIGS. 1 and 2, a foam member-inserted non-combustible fabric gasket for a fire door, according to the present invention, includes a tubular body 100 and a core body 200 inserted into a hollow 108 of the tubular body 100.

The tubular body 100 is formed by rolling a flexible gasket fabric into a tubular shape and forming a joint portion 110 via adhesion. The flexible gasket fabric is formed by coating a fibrous fabric 122, which is manufactured by weaving non-combustible fibers, with a flame-retardant or non-combustible coating material 124. The coating material 124 used herein may be a general flame-retardant or non-combustible silicone or urethane coating material and may be selected from among other various materials that may maintain flexibility of the tubular body 100 after coating.

The non-flammable fibers may be selected from among various types of flame-retardant materials which do not easily burn in case of fire, such as fiberglass fiber, carbon fiber, and ceramic fiber. As the joint portion 110 is formed where two ends of the tubular body 100 overlaps, with the rest of the tubular body 100 having a closed shape, the cross-sectional shape of the tubular body 100 may be typically circular or oval. However, without limitations thereto, the tubular body 100 may have other various cross-sectional shapes that may be formed by pressing one or more portions of the tubular body 100.

The bond strength of the joint portion 110 may be determined considering the second foaming temperature of a second foam included in the core body 200 and the expansion pressure caused by the foaming in case of fire and may be set by, e.g., the bonding capacity or bonding area of the adhesive. Although the drawings show an example in which the joint portion has a constant width, the adhesion pattern formed along the lengthwise direction may vary.

The core body 200 is formed in the shape of a sponge as a first foam is foamed at a first foaming temperature. The core body 200 is inserted into the hollow 108 of the tubular body 100 and is foamed at a second foaming temperature when a fire occurs. The first foam may be a typical urethane foam and be foamed under a generally low foaming temperature condition before reaching a high temperature condition, such as when a fire occurs.

The core body 200 may be foamed to expand to the outside of the tubular body 100 while separating the joint portion 110 of the tubular body 100 by the expansion pressure, filling and sealing off the gap between the door 10 and the door frame 20.

High heat from fire may deform the door and door frame which are formed of steel, resultantly leaving a gap between the door and door frame which was not there at the time the gasket was installed and breaking the sealed state therebetween. However, according to the present invention, second foaming occurs while the gap forms, filling the gap. Further, the outer surface of the second foam directly receives the external heat so that the second foam meets the foaming condition and thus foams. As the heat is transferred to the center of the core body 200, the core body of the foam sequentially foams. In other words, the foaming of the core body 200 occurs not instantly, but steadily as heat is transferred up to the center of the core body 200. Accordingly, the gap between the door 10 and the door frame 20 may remain sealed as the foam continuously expands while foaming.

According to the present invention, the core body may be a foaming sponge that is first foamed by a first foam at the first foaming temperature lower than the second foaming temperature and may include a flame-retardant material and a second foam that is foamed at the second foaming temperature.

The second foaming temperature may be a temperature caused by the heat transferred to the core body 200 around the time when the door 10 and the door frame 20 which are steel structures are about to deform. A proper temperature may be determined by a test on a structure actually installed in site, and thereby, a composition of the foam may be selected and the foaming temperature may be set. Typically, since a steel structure is bent at about 600° C., the heat transferred to the gasket installed in the groove of the door frame 20 may have a temperature, e.g., about 250° C., lower than 600° C., and the second foaming temperature may be set to about 250° C. The core body 200 may be continuously foamed until the temperature in the center of the core body 200 reaches the second foaming temperature. As an example, foaming occurs even when the ambient temperature of the core body 200 further increases to be higher than 250° C.

That is, the core body 200 is manufactured by mixing the first foam with a flame retardant or a non-combustible material and the second foam and foaming the first foam at a low temperature, with the second foam not foamed at the first foaming temperature. The manufactured core body 200 is cut into a rod shape having various cross-sectional shapes sized to be inserted into the hollow of the tubular body 100. However, the cross-sectional shape of the core body 200 may be preferably a radial cross shape or circular shape that is inserted into the center of the tubular body 100 to radially open the tubular body 100, but is not limited thereto.

In other words, according to the present invention, as the core body 200 inserted into the tubular body 100 may be shaped to radially press-fit the inner wall of the tubular body 100 in at least two opposite directions, the tubular body 100 may elastically remain in shape with the minimized chance of deformation by the repetitive opening and closing of the door under a normal temperature condition where no fire occurs, and the sealing and insulating functions of the gasket may be maintained.

Figure 3:
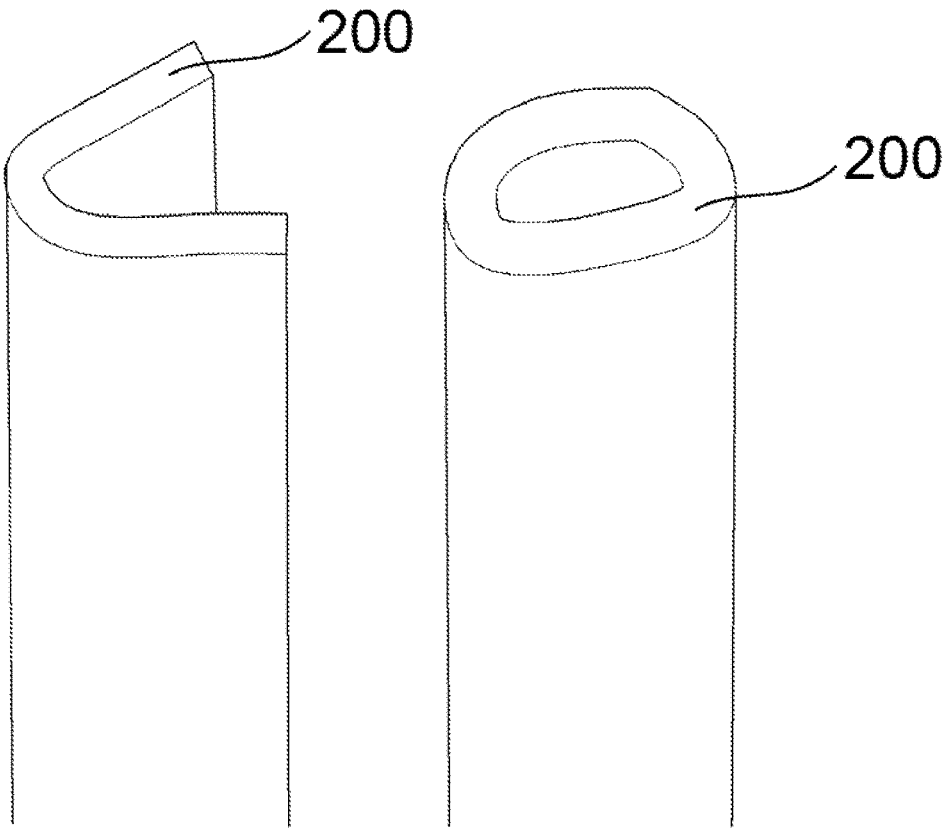
FIG. 3 is a perspective view illustrating two example central bodies of a foam member-inserted non-combustible fabric gasket for a fire door according to an embodiment of the present invention.

As long as the above functions may be achieved, the cross-sectional shape of the core body 200 is not limited to those shown in the drawings, but may rather be varied, such as a straight, triangle, and U shape. FIG. 3 illustrates a curved core body and a circular core body as examples.

Another method for manufacturing the core body 200 may include foaming the first foam and then evenly impregnating a powdered second foam adjusted to the second foaming temperature in the pores of the first foam. It is preferable to add a hardening process using a hardener after impregnation so as to remove a scattering of the powder dust.

Figure 4:
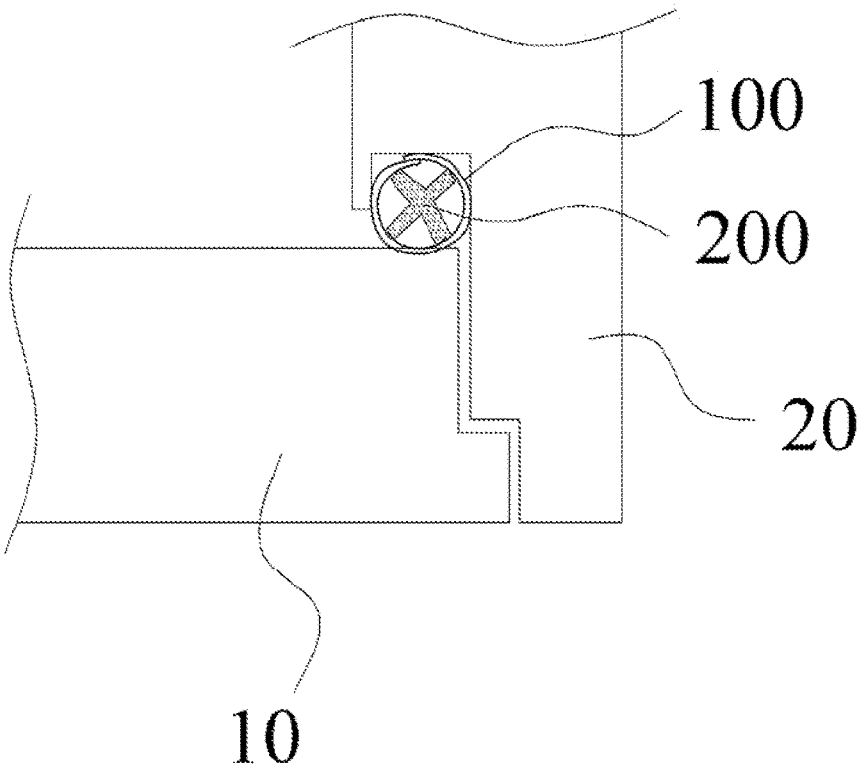
FIG. 4 is a view illustrating an example in which a foam member-inserted non-combustible fabric gasket for a fire door is placed in a groove of a door frame according to an embodiment of the present invention.
Figure 5:
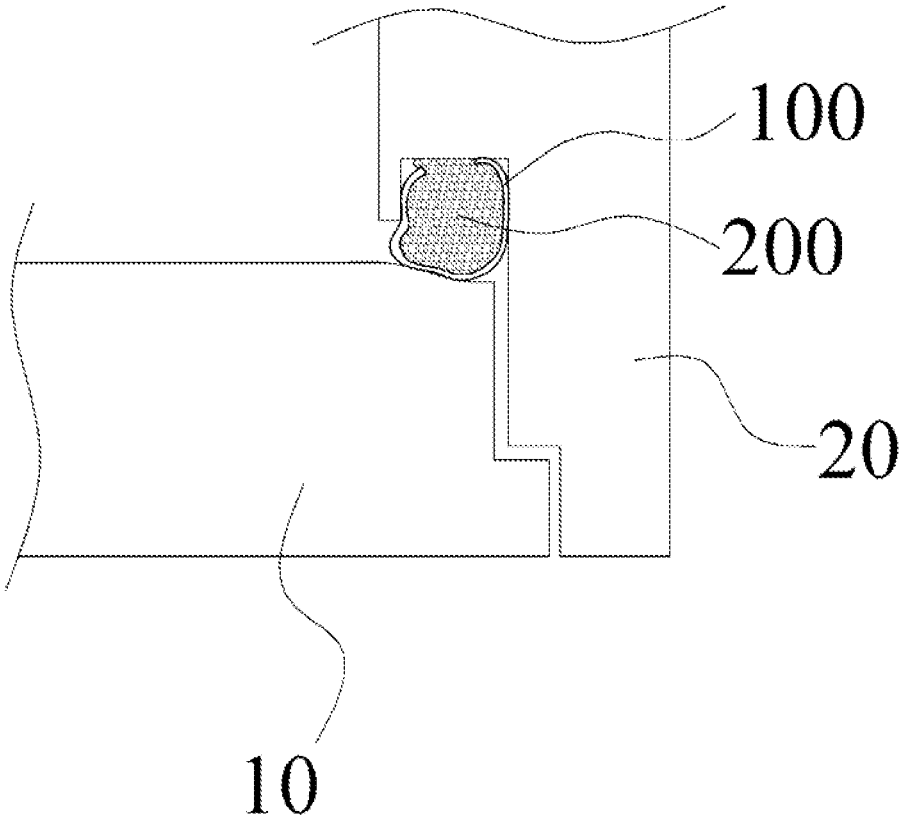
FIG. 5 is a view illustrating an example in which a core body foams when a fire occurs.

FIG. 4 is a view illustrating an example in which a foam member-inserted non-combustible fabric gasket for a fire door is placed in a groove of a door frame according to an embodiment of the present invention. FIG. 5 is a view illustrating an example in which a core body foams when a fire occurs. Referring to FIG. 4, as a preferred embodiment of inserting and installing the gasket of the present invention into the groove of the door frame 20, the gasket is installed so that the joint portion of the tubular body 100 faces the inside of the groove of the door frame 20. Referring to FIG. 5, as the second foam included in the core body 200 is foamed at the second foaming temperature when a fire occurs, the joint portion 110 of the tubular body 100 opens towards the inner wall of the groove of the door frame 20, and the tubular body 100 is pushed out of the groove of the door frame 20 while the inside of the groove is sealed by the foaming. Thus, the space between the door 10 and the door frame 20 may remain sealed, maintaining heat blocking, insulation, or flame prevention.

Although the preferred embodiments of the present invention have been illustrated and described above, the present invention is not limited to the specific embodiments described above, but it will be appreciated by one of ordinary skill in the art that various modifications may be made thereto without departing from the gist of the present invention claimed in the claims. Further, matters that may be easily inferred from the accompanying drawings should be considered to belong to the scope of the present invention although not described in the detailed description, and various modifications should not be individually understood from the technical spirit or scope of the present invention.

The invention claimed is:

1. A foam, non-combustible fabric gasket for a fire door, the non-combustible fabric gasket positioned into a groove in a door frame of the fire door to block movement of flames between the door and the door frame when a fire occurs, the non-combustible fabric gasket comprising:

a tubular body formed by rolling a flexible gasket fabric into a tubular shape and forming a joint portion by adhesion, the flexible gasket fabric formed by coating a fibrous fabric woven with non-combustible fibers with a flame-retardant or non-combustible coating material; and a core body inserted into a hollow of the tubular body, the core body foaming at a second foams temperature when a fire occurs neat the core body, wherein as the joint portion of the tubular body is separated by expansion pressure of the foaming of the core body, the core body is expanded to an outside of the tubular body such that the joint portion becomes separated, wherein the core body includes a foaming sponge formed by a first foam and a second foam, wherein the first foam foams at a first foaming temperature and the second foam foams at the second foaming temperature, wherein the first foaming temperature is lower then the second foaming temperature.

2. The foam, non-combustible fabric gasket of claim 1, wherein the core body inserted in the tubular body is formed to radially press-fit an inner wall of the tubular body in at least two opposite directions to elastically keep the tubular body in shape before the fire occurs.

* * * * *